US011075066B2

(12) United States Patent
Itagaki et al.

(10) Patent No.: US 11,075,066 B2
(45) Date of Patent: Jul. 27, 2021

(54) AUTOMATED DETECTION OF NANOPARTICLES USING SINGLE-PARTICLE INDUCTIVELY COUPLED PLASMA MASS SPECTROMETRY (SP-ICP-MS)

(71) Applicant: Agilent Technologies, Inc., Santa Clara, CA (US)

(72) Inventors: Takayuki Itagaki, Hachioji (JP); Steven Wilbur, Lopez Island, WA (US); Michiko Yamanaka, Kodaira (JP)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 16/591,442

(22) Filed: Oct. 2, 2019

(65) Prior Publication Data

US 2020/0135443 A1 Apr. 30, 2020

Related U.S. Application Data

(60) Provisional application No. 62/751,259, filed on Oct. 26, 2018.

(51) Int. Cl.
*H01J 49/00* (2006.01)
*H01J 49/10* (2006.01)
(Continued)

(52) U.S. Cl.
CPC ..... *H01J 49/105* (2013.01); *H01J 49/0036* (2013.01); *H01J 49/24* (2013.01); *H01J 49/4225* (2013.01)

(58) Field of Classification Search
CPC ..... H01J 49/0036; H01J 49/105; H01J 49/24; H01J 49/4225
See application file for complete search history.

(56) References Cited

U.S. PATENT DOCUMENTS

2015/0235833 A1* 8/2015 Bazargan ..... H01J 49/0036 702/189
2017/0358438 A1* 12/2017 Bazargan ..... H01J 49/0036

OTHER PUBLICATIONS

Mitrano et al., Nanomaterials in the Environment: Detecting Nanoparticulate Silver Using Single-Particle Inductively Coupled Plasma-Mass Spectrometry, Environmental Toxicology and Chemistry, vol. 31, No. 1, pp. 115-121, 2012, United States.
(Continued)

*Primary Examiner* — Wyatt A Stoffa

(57) ABSTRACT

Particles such as nanoparticles in a sample are analyzed by single-particle inductively coupled plasma-mass spectrometry (spICP-MS). The sample is processed in an ICP-MS system to acquire time scan data corresponding to ion signal intensity versus time. A signal distribution, corresponding to ion signal intensity and the frequency at which the ion signal intensity was measured, is determined from the time scan data. A particle detection threshold is determined as an intersection point of an ionic signal portion and a particle signal portion of the signal distribution. The particle signal portion corresponds to measurements of particles in the sample, and the ionic signal portion corresponds to measurements of components in the sample other than particles. The particle detection threshold separates the particle signal portion from the ionic signal portion, and may be utilized to determine data regarding the particles.

13 Claims, 17 Drawing Sheets

(51) Int. Cl.
*H01J 49/24* (2006.01)
*H01J 49/42* (2006.01)

(56) References Cited

OTHER PUBLICATIONS

Sannac, Single Particle Analysis of Nanomaterials using the Agilent 7900 ICP-MS, Nov. 11, 2015.

* cited by examiner

| | 197 Au (Conventional Algorithm) | | | | 197 Au (New Algorithm) | | | |
|---|---|---|---|---|---|---|---|---|
| | # of Particles | Median Size (nm) | Mean Size (nm) | Most Freq. Size (nm) | # of Particles | Median Size (nm) | Mean Size (nm) | Most Freq. Size (nm) |
| | 686 | 26.07 | 23.67 | 28.00 | 587 | 27.14 | 27.13 | 28.00 |
| | 588 | 26.47 | 26.84 | 28.00 | 591 | 27.21 | 27.52 | 28.00 |
| | 588 | 26.34 | 26.69 | 28.00 | 573 | 27.06 | 27.31 | 28.00 |
| | 558 | 26.56 | 26.78 | 28.00 | 559 | 27.31 | 27.52 | 28.00 |
| | 599 | 26.39 | 26.61 | 28.00 | 599 | 27.18 | 27.38 | 28.00 |
| RSD (%) | 7.58% | 0.63% | 4.70% | 0.00% | 2.44% | 0.30% | 0.54% | 0.00% |
| Average | 600 | 26.37 | 26.12 | 28.00 | 582 | 27.18 | 27.37 | 28.00 |

Table 1: Comparison between conventional algorithm and new algorithm in NIST8012 (Au 30nm) 5ppt.

FIG. 9

| | 197 Au (Conventional Algorithm) | | | | 197 Au (New Algorithm) | | | |
|---|---|---|---|---|---|---|---|---|
| | # of Particles | Median Size (nm) | Mean Size (nm) | Most Freq. Size (nm) | # of Particles | Median Size (nm) | Mean Size (nm) | Most Freq. Size (nm) |
| | 1179 | 50.70 | 33.94 | 8.00 | 625 | 57.08 | 58.16 | 58.00 |
| | 883 | 54.47 | 45.80 | 56.00 | 718 | 57.00 | 55.65 | 58.00 |
| | 884 | 54.07 | 43.55 | 56.00 | 641 | 57.10 | 57.92 | 58.00 |
| | 859 | 54.28 | 45.54 | 56.00 | 656 | 57.19 | 58.18 | 58.00 |
| | 886 | 54.10 | 44.09 | 56.00 | 656 | 57.06 | 57.71 | 58.00 |
| RSD (%) | 12.68% | 2.65% | 10.35% | 41.38% | 4.79% | 0.11% | 1.65% | 0.00% |
| Average | 938 | 53.52 | 42.58 | 46.40 | 659 | 57.09 | 57.53 | 58.00 |

Table 2: Comparison between conventional algorithm and new algorithm in NIST8013 (Au 60nm) 50ppt.

FIG. 10

| | 107 Ag (Conventional Algorithm) | | | | 107 Ag (New Algorithm) | | | |
|---|---|---|---|---|---|---|---|---|
| | # of Particles | Median Size (nm) | Mean Size (nm) | Most Freq. Size (nm) | # of Particles | Median Size (nm) | Mean Size (nm) | Most Freq. Size (nm) |
| Ag100nm+DIW 100ppt | 6475 | 13.85 | 23.80 | 14.00 | 540 | 111.20 | 107.63 | 114.00 |
| Ag100nm+DIW 100ppt_Ionic 20uf 20ppt | 18460 | 17.01 | 39.41 | 16.00 | 485 | 108.66 | 105.70 | 114.00 |
| Ag100nm+DIW 100ppt_Ionic 20uf 40ppt | 36844 | 19.39 | 21.17 | 18.00 | 494 | 106.39 | 103.42 | 110.00 |
| Ag100nm+DIW 100ppt_Ionic 20uf 60ppt | 46610 | 22.05 | 23.53 | 18.00 | 524 | 103.83 | 101.89 | 108.00 |
| Ag100nm+DIW 100ppt_Ionic 20uf 80ppt | 485 | 113.23 | 113.00 | 114.00 | 504 | 100.60 | 99.31 | 102.00 |
| Ag100nm+DIW 100ppt_Ionic 20uf 100ppt | 2790 | 23.82 | 39.24 | 24.00 | 510 | 98.84 | 96.65 | 96.00 |
| Ag100nm+DIW 100ppt_Ionic 20uf 120ppt | 28067 | 26.36 | 28.46 | 26.00 | 478 | 97.55 | 96.84 | 100.00 |
| Ag100nm+DIW 100ppt_Ionic 20uf 140ppt | 1138 | 27.25 | 60.12 | 26.00 | 485 | 95.42 | 94.75 | 96.00 |
| Ag100nm+DIW 100ppt_Ionic 20uf 160ppt | 3710 | 25.89 | 37.03 | 26.00 | 504 | 93.54 | 94.18 | 90.00 |
| Ag100nm+DIW 100ppt_Ionic 20uf 180ppt | 452 | 104.78 | 103.03 | 106.00 | 486 | 93.32 | 93.43 | 94.00 |
| Ag100nm+DIW 100ppt_Ionic 20uf 200ppt | 3228 | 27.37 | 40.37 | 28.00 | 547 | 92.58 | 91.96 | 94.00 |
| Ag100nm+DIW 100ppt_Ionic 20uf 220ppt | 489 | 101.24 | 98.73 | 104.00 | 487 | 90.65 | 89.45 | 92.00 |
| Ag100nm+DIW 100ppt_Ionic 20uf 240ppt | 531 | 101.47 | 97.06 | 108.00 | 501 | 90.75 | 90.02 | 92.00 |
| Ag100nm+DIW 100ppt_Ionic 20uf 260ppt | 569 | 99.75 | 98.85 | 106.00 | 534 | 89.44 | 89.20 | 88.00 |
| Ag100nm+DIW 100ppt_Ionic 20uf 280ppt | 548 | 99.33 | 93.67 | 96.00 | 497 | 90.01 | 89.30 | 88.00 |
| RSD (%) | 145.28% | 72.61% | 57.93% | 74.90% | 5.51% | 7.09% | 6.18% | 8.83% |
| Average | 10027 | 54.85 | 59.56 | 55.47 | 500 | 97.52 | 96.25 | 98.53 |

Table 3: Comparison between conventional algorithm and new algorithm in 100nm Ag NPs with different ionic concentrations.

FIG. 11

New Algorithm

Conventional Algorithm

10nm:0.1ppt, 30nm:2ppt, 60nm:30ppt

10nm:0.08ppt, 30nm:1.7ppt, 60nm:17ppt

| | 107 Ag (Conventional Algorithm) | | | | 107 Ag (New Algorithm) | | | |
|---|---|---|---|---|---|---|---|---|
| | # of Particles | Median Size (nm) | Mean Size (nm) | Most Freq. Size (nm) | # of Particles | Median Size (nm) | Mean Size (nm) | Most Freq. Size (nm) |
| Ag20nm 1ppt_20ml | 393 | 19.43 | 19.30 | 12.00 | 280 | 17.35 | 17.93 | 18.00 |
| Ag20nm 2ppt_40ml | 798 | 18.83 | 18.86 | 12.00 | 568 | 17.68 | 17.89 | 20.00 |
| Ag20nm 5ppt_100ml | 1434 | 21.04 | 21.28 | 22.00 | 1512 | 17.35 | 17.53 | 20.00 |
| Ag20nm 10ppt_200ml | 5808 | 14.46 | 17.65 | 12.00 | 3848 | 17.45 | 17.82 | 18.00 |
| Ag20nm 20ppt_400ml | 8859 | 19.33 | 20.28 | 14.00 | 6245 | 17.14 | 17.50 | 18.00 |
| Ag20nm 50ppt_1000ml | 24227 | 21.06 | 32.42 | 18.00 | 13683 | 17.50 | 18.01 | 18.00 |
| Ag20nm 100ppt_2000ml | 15575 | 26.55 | 27.60 | 24.00 | 24734 | 17.80 | 18.46 | 14.00 |
| RSD (%) | | 16.67% | 14.39% | 38.93% | | 1.16% | 1.67% | 10.29% |
| Average | | 20.09 | 21.07 | 16.29 | | 17.47 | 17.88 | 18.00 |

Table 4: Comparison between conventional algorithm and new algorithm in 20nm Ag NPs in different concentrations (1ppt, 2ppt, 5ppt, 10ppt, 20ppt, 50ppt, 100ppt).

FIG. 14

| | 107 Au (Conventional Algorithm) | 107 Au (New Algorithm) |
|---|---|---|
| | # of Particles | # of Particles |
| UPW | 0 | 0 |
| 0.01% Cysteine | 17 | 0 |
| Au 1ppt | 23 | 0 |
| Au 2ppt | 33 | 0 |
| Au 1ppt | 91 | 0 |
| Au 2ppt | 273 | 0 |
| Au 5ppt | 313 | 2 |
| Au 10ppt | 358 | 15 |
| Au 20ppt | 423 | 4 |
| Au 50ppt | 628 | 0 |
| Au 100ppt | 653 | 2 |
| Au 100ppt | 763 | 1 |
| Au 200ppt | 793 | 2 |
| Au 500ppt | 26590 | 1 |
| Au 1000ppt | 34674 | 4 |
| Au 200ppt | 35112 | 15 |

Table 5: Comparison between conventional algorithm and new algorithm in UPW, blank and Au ionic samples.

FIG. 16

AUTOMATED DETECTION OF NANOPARTICLES USING SINGLE-PARTICLE INDUCTIVELY COUPLED PLASMA MASS SPECTROMETRY (SP-ICP-MS)

RELATED APPLICATIONS

This application claims the benefit under 35 U.S.C. § 119(e) of U.S. Provisional Patent Application Ser. No. 62/751,259, filed Oct. 26, 2018, titled "AUTOMATED DETECTION OF NANOPARTICLES USING SINGLE-PARTICLE INDUCTIVELY COUPLED PLASMA MASS SPECTROMETRY (SP-ICP-MS)," the content of which is incorporated by reference herein in its entirety.

TECHNICAL FIELD

The present invention relates generally to inductively coupled plasma-mass spectrometry (ICP-MS), and particularly to the detection of particles (e.g., nanoparticles) by single-particle ICP-MS (spICP-MS).

BACKGROUND

Inductively coupled plasma-mass spectrometry (ICP-MS) is often utilized for elemental analysis of a sample, such as to measure the concentration of trace metals in the sample. An ICP-MS system includes a plasma-based ion source to generate plasma to break molecules of the sample down to atoms and then ionize the atoms in preparation for the elemental analysis. In a typical operation, a liquid sample is nebulized, i.e., converted to an aerosol (a fine spray or mist), by a nebulizer (typically of the pneumatic assisted type) and the aerosolized sample is directed into a plasma plume generated by a plasma source. The plasma source often is configured as a flow-through plasma torch having two or more concentric tubes. Typically, a plasma-forming gas such as argon flows through an outer tube of the torch and is energized into a plasma by an appropriate energy source (typically a radio frequency (RF) powered load coil). The aerosolized sample flows through a coaxial central tube (or capillary) of the torch and is emitted into the as-generated plasma. Exposure to plasma breaks the sample molecules down to atoms, or alternatively partially breaks the sample molecules into molecular fragments, and ionizes the atoms or molecular fragments.

The resulting analyte ions, which are typically positively charged, are extracted from the plasma source and directed as an ion beam into a mass analyzer. The mass analyzer applies a time-varying electrical field, or a combination of electrical and magnetic fields, to spectrally resolve ions of differing masses on the basis of their mass-to-charge ratios (m/z), enabling an ion detector to then count each type of ion of a given m/z ratio arriving at the ion detector from the mass analyzer. Alternatively the mass analyzer may be a time of flight (TOF) analyzer, which measures the times of flight of ions drifting through a flight tube, from which m/z values may then be derived. The ICP-MS system then presents the data so acquired as a spectrum of mass (m/z) peaks. The intensity of each peak is indicative of the concentration (abundance) of the corresponding element of the sample.

Advances in nanotechnology are forecast to have a major impact on wide segments of industry, such as manufactured goods, medicines, consumer products (e.g., cosmetics, sunscreens, foods, semiconductors, etc.), environmental engineering, etc. Consequently, the measurement of nanoparticles (NPs) is a focus of attention, because the fate of NPs in the environment and the potential for toxic effects once absorbed into the body are not yet well understood.

ICP-MS can be utilized to detect and measure individual nanoparticles (NPs) existing in a sample solution by implementing a technique termed single-particle ICP-MS (spICP-MS or SP-ICP-MS). This approach allows simultaneous determination of particle number concentration, elemental composition of particles, and size and size distribution of particles, by a fast data acquisition and with little sample preparation required. In spICP-MS, the analytes of interest are the solid NPs known or suspected to be suspended in the sample solution. The suspended NPs must be distinguished from the other species found in the sample solution, including dissolved NPs. In spICP-MS, the species other than the NPs are considered to be background species. When the sample is ionized in the ICP-MS ion source, ion bursts (or pulses) are produced from the NPs in the sample. The intensity of the peaks of these ion bursts measured by the ion detector is higher than the intensity of the background signal resulting from measurement of the ionized background species. As the "particle signal" corresponding to detection (measurement) of the NPs is the signal of interest in spICP-MS, the background signal—often termed the "ionic signal" in spICP-MS—is considered to be noise. Therefore, to accurately measure the NPs of the sample, the particle signal needs to be distinguished from the background, or ionic, signal.

The particle signal may be distinguished from the ionic signal by configuring the signal processing or data analyzing portion of the ICP-MS system to execute an appropriate algorithm on the raw time scan (ion signal intensity versus time) data obtained from the output of the ion detector. One known approach is described in Mitrano et al., "Detecting Nanoparticulate Silver Using Single-particle Inductively Coupled Plasma-Mass Spectrometry, Environmental Toxicology and Chemistry, Vol. 31, No. 1, p. 115-121 (2012). In this approach, an iterative algorithm is employed to calculate a threshold limit that is considered to distinguish the particle signal from the ionic signal in the raw data. Here, the threshold limit is defined by repetitive $3*\sigma$ ("three times sigma"), where $\sigma$ is the standard deviation of the signal intensity of the raw data. The data points exceeding $I^{-}+3*\sigma$, where $I^{-}$ is the average signal intensity of the raw data, are considered to be nanoparticle signals and are removed from the dataset. The value $I^{-}+3*\sigma$ is calculated again from the remaining dataset, and additional data points exceeding $I^{-}+3*\sigma$ are removed. The iteration is repeated until no further data points can be removed. In this manner, the higher-intensity peaks may be separated from the underlying background noise and identified as ion pulses corresponding to NPs contained in the sample under analysis. As an example of implementing this algorithm, the supplementary information accompanying the Mitrano et al. reference includes a plot of a time scan data (measured ion signal intensity versus time) representing the result of a data acquisition by spICP-MS on a sample containing solid silver (Ag) NPs. The threshold limit calculated by the repetitive $3*\sigma$-process is shown as a line parallel to the horizontal time axis. Spikes in the ion signal above the threshold limit are identified as nanoparticle signals, while the remaining portion of the ion signal below the threshold limit is identified as the background ionic signal.

The conventional algorithm just described could be generalized by using the variable $n*\sigma$ instead of exclusively using $3*\sigma$, and the value n could be changed for different elements and different samples by the analyst. However, the choice of n*σ is a critical parameter for the analysis. In other words, changing the value of n can have a significant effect on the final result.

The conventional algorithm may work adequately for some samples, but it often results in differing values for the threshold limit for particle detection, even in a reference material sample, or even in the same samples that are supplied in different vials. A miscalculated value for the threshold limit can lead to inaccurate calculations and analysis of the data acquired from a sample by ICP-MS. For example, calculations of certain particle data such as particle concentration and size depend on nebulization efficiency, which is a component of the efficiency of the sample introduction system of the ICP-MS system. Nebulization efficiency accounts for the fact that only a fraction (e.g., less than 10%) of the NPs in a sample are actually detected by the ICP-MS system, and may be determined by analyzing a reference material containing NPs with a known particle size in the ICP-MS system. If the threshold value for the reference material is miscalculated, the result for unknown samples will also fail because the nebulization efficiency cannot be correctly determined.

Therefore, there continues to be a need for spICP-MS techniques that are effective in distinguishing particles from background noise. Moreover, spICP-MS techniques capable of detecting and measuring particles with improved accuracy would be desirable.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one embodiment, a method for analyzing nanoparticles in a sample by single-particle inductively coupled plasma-mass spectrometry (spICP-MS) includes: processing the sample in an ICP-MS system to acquire raw sample data corresponding to ion signal intensity as a function of time measured by an ion detector of the ICP-MS system; determining a signal distribution of the raw sample data corresponding to a plurality of data points, each data point corresponding to ion signal intensity and the frequency at which the ion detector measured the ion signal intensity; and determining a particle detection threshold as an intersection point of an ionic signal portion of the signal distribution and a particle signal portion of the signal distribution, wherein the particle signal portion corresponds to measurements of nanoparticles in the sample, the ionic signal portion corresponds to measurements of components in the sample other than nanoparticles, and the particle detection threshold separates the particle signal portion from the ionic signal portion.

According to another embodiment, an inductively coupled plasma-mass spectrometry (ICP-MS) system includes: a torch box configured to generate plasma and produce ions from the sample in the plasma; a mass analyzer configured to separate the ions according to mass-to-charge ratio; an ion detector configured to count ions received from the mass analyzer; and a controller comprising an electronic processor and a memory, and configured to control the steps of any of the methods disclosed herein.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

FIG. 9 is a table (Table 1) comparing the results obtained from analyzing a reference solution containing NIST8012 (Au 30 nm) 5 ppt particles by spICP-MS in five sample runs, utilizing the presently disclosed method ("New Algorithm") versus the conventional algorithm ("Conventional Algorithm").

FIG. 10 is a table (Table 2) comparing the results obtained from analyzing a reference solution containing NIST8013 (Au 60 nm) 50 ppt particles by spICP-MS in five sample runs, utilizing the presently disclosed method ("New Algorithm") versus the conventional algorithm ("Conventional Algorithm").

FIG. 11 is a table (Table 3) comparing the results obtained from analyzing several reference solutions, each containing 100 nm Ag NPs but with different ionic concentrations, by spICP-MS, utilizing the presently disclosed method ("New Algorithm") versus the conventional algorithm ("Conventional Algorithm").

FIG. 14 (Table 4) is a table comparing the results obtained from analyzing reference solutions containing 20 nm Ag NPs in different concentrations (1 ppt, 2 ppt, 5 ppt, 10 ppt, 20 ppt, 50 ppt, and 100 ppt), utilizing the presently disclosed method ("New Algorithm") versus the conventional algorithm ("Conventional Algorithm").

FIG. 16 (Table 5) is a table comparing the calculated number of particles from analyses of ultra-pure water (UPW), a blank solution, and several Au ionic samples with different concentrations, utilizing the presently disclosed method ("New Algorithm") versus the conventional algorithm ("Conventional Algorithm").

DETAILED DESCRIPTION

Figure 1:
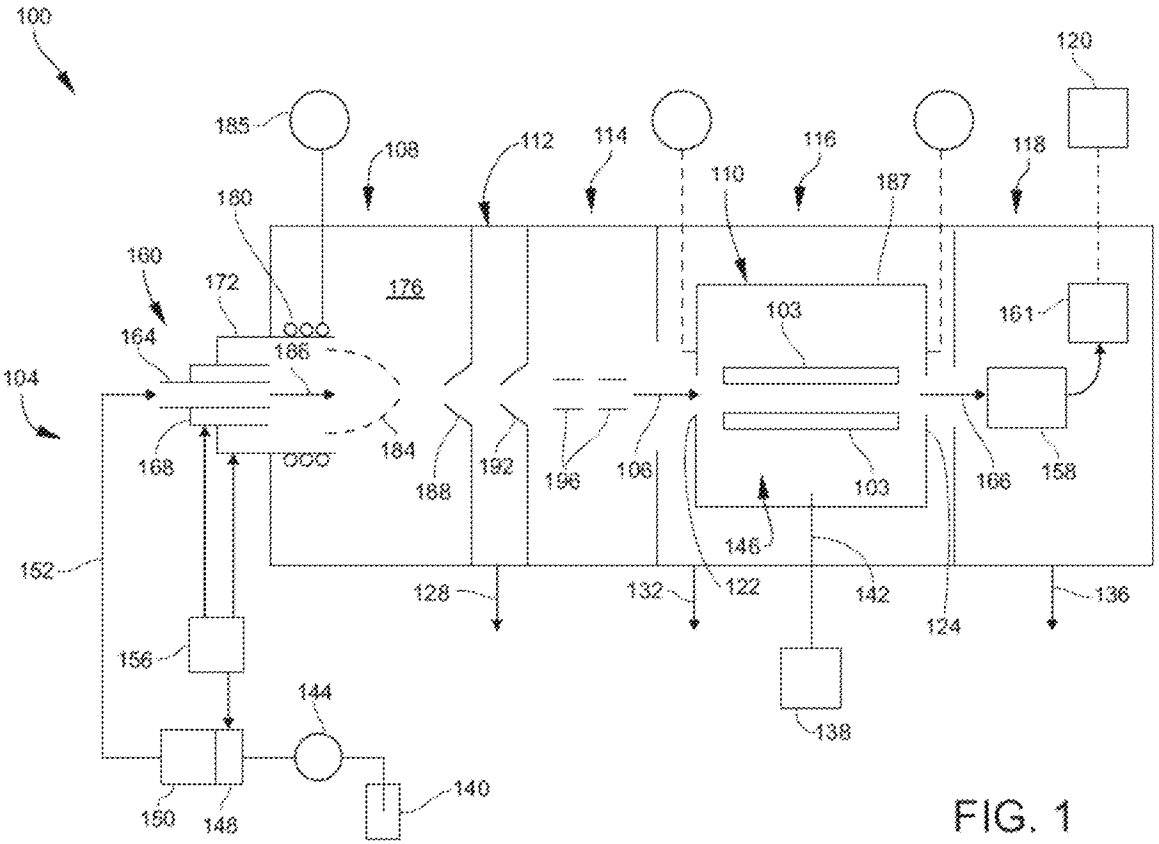
FIG. 1 is a schematic view of an example of an inductively coupled plasma-mass spectrometry (ICP-MS) system according to an embodiment of the present disclosure.

FIG. 1 is a schematic view of an example of an inductively coupled plasma-mass spectrometry (ICP-MS) system 100 according to an embodiment. Generally, the structures and operations of various components of ICP-MS systems are known to persons skilled in the art, and accordingly are described only briefly herein as necessary for understanding the subject matter being disclosed. The ICP-MS system 100 is but one example of an ICP-MS system suitable for implementing any of the methods described herein. Other ICP-MS systems not specifically described herein may be suitable as well.

In the present illustrative embodiment, the ICP-MS system 100 generally includes a sample introduction section 104, an ion source 108, an interface section 112, an ion optics section 114, an ion guide section 116, a mass analysis section 118, and a system controller 120. The ICP-MS system 100 also includes a vacuum system configured to exhaust various internal regions of the system 100. The vacuum system maintains desired internal pressures or vacuum levels in the internal regions, and in doing so removes neutral molecules not of analytical interest from the ICP-MS system 100. The vacuum system includes appropriate pumps and passages communicating with ports of the regions to be evacuated, as depicted by arrows 128, 132, and 136 in FIG. 1.

The sample introduction section 104 may include a sample source 140 for providing the sample to be analyzed, a pump 144, a nebulizer 148 for converting the sample into an aerosol, a spray chamber 150 for removing larger droplets from the aerosolized sample, and a sample supply conduit 152 for supplying the sample to the ion source 108, which may include a suitable sample injector. The nebulizer 148 may, for example, utilize a flow of argon or other inert gas (nebulizing gas) from a gas source 156 (e.g., a pressurized reservoir) to aerosolize the sample, as depicted by a downward arrow. The nebulizing gas may be the same gas as the plasma-forming gas utilized to create plasma in the ion source 108, or may be a different gas. The pump 144 (e.g., peristaltic pump, syringe pump, etc.) is connected between the sample source 140 and the nebulizer 148 to establish a flow of liquid sample to the nebulizer 148. The sample flow rate may be in the range between, for example, 0.1 and a few milliliters per minute (mL/min). The sample source 140 may, for example, include one or more vials. A plurality of vials may contain one or more samples, various standard solutions, a tuning liquid, a calibration liquid, a rinse liquid, etc. The sample source 140 may include an automated device configured to switch between different vials, thereby enabling the selection of a particular vial for present use in the ICP-MS system 100.

The sample is typically a liquid sample, and may also be referred to herein as a sample solution. Generally, a "liquid sample" includes one or more different types of analytes of interest dissolved or otherwise carried in a liquid matrix. The liquid matrix includes matrix components. Examples of "matrix components" include, but are not limited to, water and/or other solvents, acids, soluble materials such as salts and/or dissolved solids, undissolved solids or particulates, and any other compounds that are not of analytical interest. In the context of single-particle ICP-MS (spICP-MS), i.e. ICP-MS operating in single-particle mode, the analytes of interest are the solid (undissolved) particles (nanoparticles) present in the liquid sample introduced into the ICP-MS system 100. The remaining portion of the sample, including dissolved metal components (which may be of the same elemental composition as the solid analyte particles, are considered as being background components along with the matrix components of the sample introduced into the ICP-MS system 100.

In an embodiment, the sample source 140 may be the output of an analytical separation instrument such as, for example, a liquid chromatography (LC) or gas chromatography (GC) instrument. Other types of devices and means for sample introduction into ICP-MS systems are known and need not be described herein.

The ion source 108 includes a plasma source for atomizing and ionizing the sample. In the illustrated embodiment, the plasma source is flow-through plasma torch such as an ICP torch 160. The ICP torch 160 includes a central or sample injector 164 and one or more outer tubes concentrically arranged about the sample injector 164. In the illustrated embodiment, the ICP torch 160 includes an intermediate tube 168 and an outermost tube 172. The sample injector 164, intermediate tube 168, and outermost tube 172 may be constructed from, for example, quartz, borosilicate glass, or a ceramic. The sample injector 164 alternatively may be constructed from a metal such as, for example, platinum. The ICP torch 160 is located in a radio frequency (RF) shielded box or "torch box" 176. A work coil 180 (also termed a load coil or RF coil) is coupled to an RF power source 185 and is positioned at the discharge end of the ICP torch 160.

In operation, the gas source 156 supplies a plasma-forming gas to the outermost tube 172. The plasma-forming gas is typically, but not necessarily, argon. RF power is applied to the work coil 180 by the RF power source 185 while the plasma-forming gas flows through the annular channel formed between the intermediate tube 168 and the outermost tube 172, thereby generating a high-frequency, high-energy electromagnetic field to which the plasma-forming gas is exposed. The work coil 180 is operated at a frequency and power effective for generating and maintaining plasma from the plasma-forming gas. A spark may be utilized to provide seed electrons for initially striking the plasma. Consequently, a plasma plume 184 flows from the discharge end of the ICP torch 160 into a sampling cone 188. An auxiliary gas may be flowed through the annular channel formed between the sample injector 164 and the intermediate tube 168 to keep the upstream end of the discharge 184 away from the ends of the sample injector 164 and the intermediate tube 168. The auxiliary gas may be the same gas as the plasma-forming gas or a different gas. The conduction of gas(es) into the intermediate tube 168 and the outermost tube 172 is depicted in FIG. 1 by arrows directed upward from the gas source 156. The sample flows through the sample injector 164 and is emitted from the sample injector 164 and injected into the active plasma 184, as depicted by an arrow 186. As the sample flows through the heating zones of the ICP torch 160 and eventually interacts with the plasma 184, the sample undergoes drying, vaporization, atomization, and ionization, whereby analyte ions are produced from components (particularly atoms) of the sample, according to principles appreciated by persons skilled in the art.

The interface section 112 provides the first stage of pressure reduction between the ion source 108, which typically operates at or around atmospheric pressure (760 Torr), and the evacuated regions of the ICP-MS system 100. For example, the interface section 112 may be maintained at an operating vacuum of for example around 1-2 Torr by a mechanical roughing pump (e.g., a rotary pump, scroll pump, etc.), while the mass analyzer 120 may be maintained at an operating vacuum of for example around $10^{-6}$ Torr by a high-vacuum pump (e.g., a turbomolecular pump, etc.). The interface section 112 includes a sampling cone 188 positioned across the torch box 176 from the discharge end of the ICP torch 160, and a skimmer cone 192 positioned at a small axial distance from the sampling cone 188. The sampling cone 188 and the skimmer cone 192 have small orifices at the center of their conical structures that are aligned with each other and with the central axis of the ICP torch 160. The sampling cone 188 and the skimmer cone 192 assist in extracting the plasma 184 from the torch into the vacuum chamber, and also serve as gas conductance barriers to limit the amount of gas that enters the interface section 112 from the ion source 108. The sampling cone 188 and the skimmer cone 192 may be metal (or at least the tips defining their apertures may be metal) and may be electrically grounded. Neutral gas molecules and particulates entering the interface section 112 may be exhausted from the ICP-MS system 100 via the vacuum port 128.

The ion optics section 114 may be provided between the skimmer cone 192 and the ion guide section 116. The ion optics section 114 includes a lens assembly 196, which may include a series of (typically electrostatic) ion lenses that assist in extracting the ions from the interface section 112, focusing the ions as an ion beam 106, and accelerating the ions into the ion guide section 116. The ion optics section 114 may be maintained at an operating pressure of for example around $10^{-3}$ Torr by a suitable pump (e.g., a turbomolecular pump). While not specifically shown in FIG. 1, the lens assembly 196 may be configured such that the ion optical axis through the lens assembly 196 is offset (in the radial direction orthogonal to the longitudinal axis) from the ion optical axis through the ion guide section 116, with the ion beam 106 steered through the offset. Such configuration facilitates the removal of neutral species and photons from the ion path.

The ion guide section 116 may include a collision/reaction cell (or cell assembly) 110. The collision/reaction cell 110 includes an ion guide 146 positioned in a cell housing 118 axially between a cell entrance and a cell exit. In the present embodiment, the cell entrance and cell exit are provided by ion optics components. Namely, a cell entrance lens 122 is positioned at the cell entrance, and a cell exit lens 124 is positioned at the cell exit. The ion guide 146 has a linear multipole (e.g., quadrupole, hexapole, or octopole) configuration that includes a plurality of (e.g., four, six, or eight) rod electrodes 103 arranged in parallel with each other along a common central longitudinal axis of the ion guide 146. The rod electrodes 103 are each positioned at a radial distance from the longitudinal axis, and are circumferentially spaced from each other about the longitudinal axis. For simplicity, only two such rod electrodes 103 are illustrated in FIG. 1. An RF power source (described further below) applies RF potentials to the rod electrodes 103 of the ion guide 146 in a known manner that generates a two-dimensional RF electric field between the rod electrodes 103. The RF field serves to focus the ion beam 106 along the longitudinal axis by limiting the excursions of the ions in radial directions relative to the longitudinal axis. In a typical embodiment, the ion guide 146 is an RF-only device without the capability of mass filtering. In another embodiment, the ion guide 146 may function as a mass filter, by superposing DC potentials on the RF potentials as appreciated by persons skilled in the art. In the present disclosure, a "collision/reaction cell" refers to a collision cell, a reaction cell, or a collision/reaction cell configured to operate as both a collision cell and a reaction cell, such as by being switchable between a collision mode and a reaction mode.

When the collision/reaction cell 110 is included, a collision/reaction gas source 138 (e.g., a pressurized reservoir) is configured to flow one or more (e.g., a mixture of) collision/reaction gases into the interior of the collision/reaction cell 110 via a collision/reaction gas feed conduit and port 142 leading into the interior of the cell housing 187. The gas flow rate is typically on the order of milliliters per minute (mL/min). The gas flow rate determines the pressure inside the collision/reaction cell 110. The cell operating pressure may be, for example, in a range from 0.001 Torr to 0.1 Torr. A "collision/reaction gas" refers to an inert collision gas utilized to collide with ions in a collision/reaction cell without reacting with such ions, or a reactive gas utilized to react with analyte ions or interfering ions in a collision/reaction cell. Examples of collision/reaction gases include, but are not limited to, helium, neon, argon, hydrogen, oxygen, water, ammonia, methane, fluoromethane ($CH_3F$), and nitrous oxide ($N_2O$), as well as combinations (mixtures) or two or more of the foregoing. Inert (nonreactive) gases such as helium, neon, and argon are utilized as collision gases. The operation of the collision/reaction cell 110 is generally understood by persons skilled in the art and thus need not be described detail herein. Briefly, in the collision/reaction cell 110, a collision/reaction gas of selected composition collides or reacts with certain (analyte or non-analyte) ions in a manner effective to suppress interferences and thereby improve the ion signal produced by the ICP-MS system 100. Interferences are typically suppressed by preventing, or reducing the number of, interfering ions counted by the ion detector 161.

In the present disclosure, the term "interfering ion" generally refers to any ion present in a collision/reaction cell that interferes with an analyte ion. Examples of interfering ions include, but are not limited to, positive plasma (e.g., argon) ions, polyatomic ions containing plasma-forming gases (e.g., argon), and polyatomic ions containing a component of the sample. The component of the sample may be an analyte element or a non-analyte species such as may be derived from the matrix components of the sample or other background species.

The mass analysis section 118 (also referred to herein as the mass spectrometer) includes a mass analyzer 158 and an ion detector 161. The mass analyzer 158 may be any type suitable for ICP-MS. Examples of mass analyzers typically utilized in ICP-MS include quadrupole mass filters and time-of-flight (TOF) analyzers. Other types of mass analyzers that may possibly be utilized include, but are not limited to, magnetic and/or electric sector instruments, linear ion traps, three-dimensional Paul traps, electrostatic traps (e.g. Kingdon, Knight and ORBITRAP® traps) and ion cyclotron resonance (ICR) traps (FT-ICR or FTMS, also known as Penning traps). The ion detector 161 may be any device configured for collecting and measuring the flux (or current) of mass-discriminated ions outputted from the mass analyzer 158. Examples of ion detectors include, but are not limited to, electron multipliers, photomultipliers, micro-channel plate (MCP) detectors, image current detectors, and Faraday cups. For convenience of illustration in FIG. 1, the ion detector 161 (at least the front portion that receives the ions) is shown to be oriented at a ninety degree angle to the ion exit of the mass analyzer 158. In other embodiments, however, the ion detector 161 may be on-axis with the ion exit of the mass analyzer 158.

In operation, the mass analyzer 158 receives an ion beam 166, such as from the collision/reaction cell 110 if provided, and separates or sorts the ions on the basis of their differing mass-to-charge ratios (m/z). The separated ions pass through the mass analyzer 158 and arrive at the ion detector 161. The ion detector 161 detects and counts each ion and outputs an electronic detector signal (ion measurement signal) to the data acquisition component of the system controller 120. The mass discrimination carried out by the mass analyzer 158 enables the ion detector 161 to detect and count ions having a specific m/z value separately from ions having other m/z values (derived from different analyte elements of the sample), and thereby produce ion measurement signals for each ion mass (and hence each analyte element) being analyzed. Ions with different m/z values may be detected and counted in sequence. The system controller 120 processes the signals received from the ion detector 161 and generates a mass spectrum, which shows the relative signal intensities (abundances) of each ion detected. The signal intensity so measured at a given m/z value (and therefore a given analyte element) is directly proportional to the concentration of that element in the sample processed by the ICP-MS system 100. In this manner, the existence of chemical elements contained in the sample being analyzed can be confirmed and the concentrations of the chemical elements can be determined. Other types of data regarding detected components of the sample, including particles when operating in the single-particle (spICP-MS) mode, may also be generated as described herein.

While not specifically shown in FIG. 1, the ion optical axis through the ion guide 146 and cell exit lens 124 may be offset from the ion optical axis through the entrance into the mass analyzer 158, and ion optics may be provided to steer the ion beam 166 through the offset. By this configuration, additional neutral species are removed from the ion path.

The system controller (or controller, or computing device) 120 may include one or more modules configured for controlling, monitoring and/or timing various functional aspects of the ICP-MS system 100 such as, for example, controlling the operations of the sample introduction section 104, the ion source 108, the ion optics section 114, the ion guide section 116, and the mass analysis section 118, as well as controlling the vacuum system and various gas flow rates, temperature and pressure conditions, and other sample processing components provided in the ICP-MS system 100 that require control. The system controller 120 is representative of the electrical circuitry (e.g., RF and DC voltage sources) utilized to operate the collision/reaction cell 110. The system controller 120 may also be configured for receiving the detection signals from the ion detector 161 and performing other tasks relating to data acquisition and signal analysis as necessary to generate data (e.g., a mass spectrum) characterizing the sample under analysis. The system controller 120 may include a non-transitory computer-readable medium that includes non-transitory instructions for performing any of the methods disclosed herein. The system controller 120 may include one or more types of hardware, firmware and/or software, as well as one or more memories and databases, as needed for operating the various components of the ICP-MS system 100. The system controller 120 typically includes a main electronic processor providing overall control, and may include one or more electronic processors configured for dedicated control operations or specific signal processing tasks. The system controller 120 may also include one or more types of user interface devices, such as user input devices (e.g., keypad, touch screen, mouse, and the like), user output devices (e.g., display screen, printer, visual indicators or alerts, audible indicators or alerts, and the like), a graphical user interface (GUI) controlled by software, and devices for loading media readable by the electronic processor (e.g., non-transitory logic instructions embodied in software, data, and the like). The system controller 120 may include an operating system (e.g., Microsoft Windows® software) for controlling and managing various functions of the system controller 120.

It will be understood that FIG. 1 is a high-level schematic depiction of the ICP-MS system 100 disclosed herein. As appreciated by persons skilled in the art, other components such as additional structures, devices, and electronics may be included as needed for practical implementations, depending on how the ICP-MS system 100 is configured for a given application.

Figure 2:
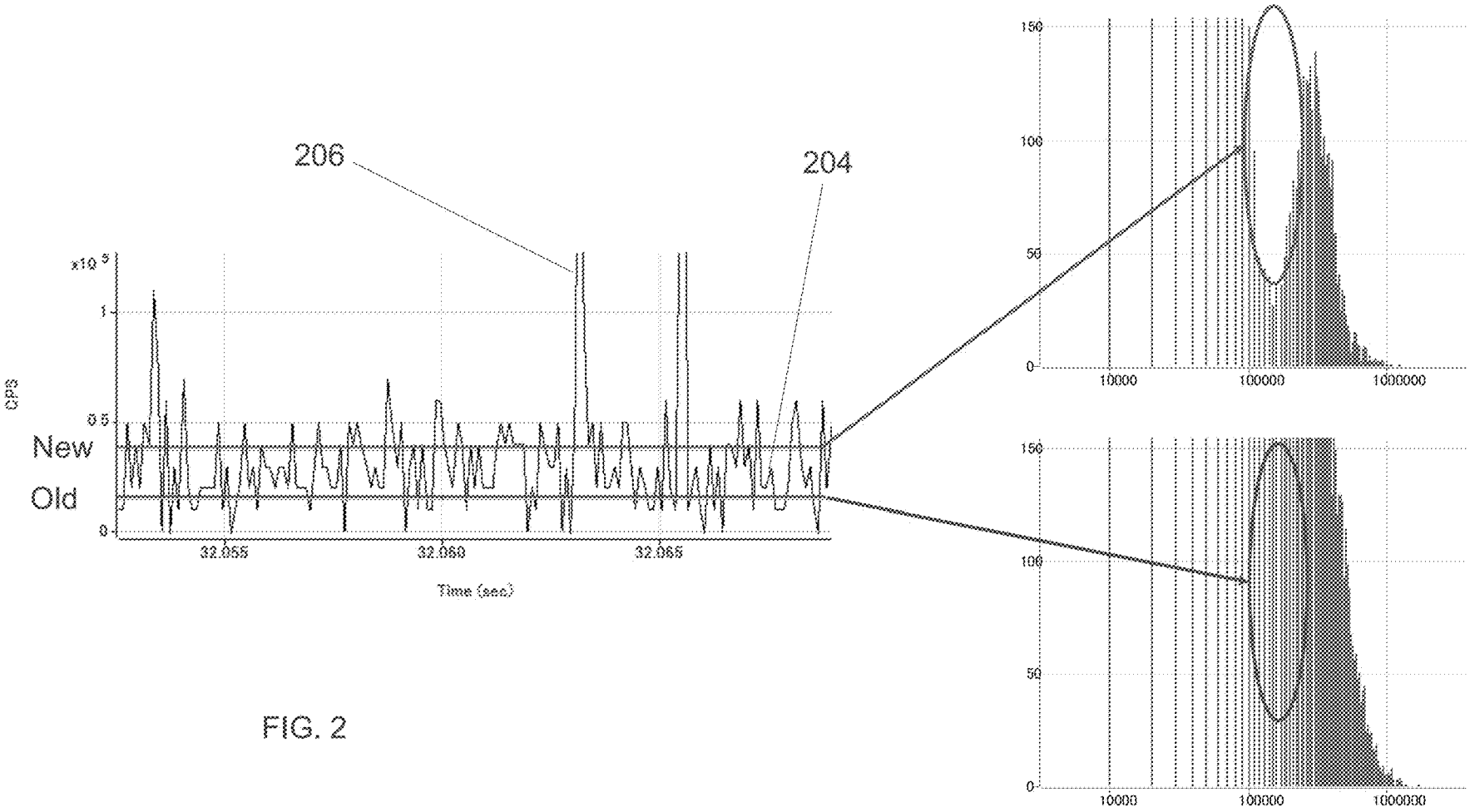
FIG. 2 is an example of a plot of raw sample data (time scale data) that may be produced by an ICP-MS system when operating in single-particle mode ICP-MS (spICP-MS) to detect nanoparticles (NPs) in a sample.

FIG. 2 is an example of a plot of raw sample data (time scale data) that may be produced by the ICP-MS system 100 when operating in single-particle (spICP-MS) mode to detect particles such as nanoparticles (NPs) in a sample. The raw sample data are a collection of ion signal data points, plotted as ion signal intensity (in counts per second, or CPS), I, as a function of measurement time (in seconds, or s), t, as measured by the ICP-MS system 100. The magnitude of the signal intensity is proportional to the concentration of metal ions in the sample detected over the indicated time period. The raw sample data may be utilized to calculate various types of data (properties or attributes) regarding the ions (including ionized nanoparticles) detected by the ion detector 161, according to various known techniques. Examples of calculated sample data include, but are not limited to, mass spectra, particle mass, concentration of mass, particle volume, particle number concentration, elemental composition, particle size (e.g., diameter), particle size distribution, etc.

Below a certain signal intensity threshold level, the intensity of the ion signal is relatively stable or constant over time, and contains relatively small intensity peaks, such as at 204 in FIG. 2. This portion of the ion signal corresponds to the measurement of dissolved metals in the sample. The ion signal may also contain relatively high intensity peaks, or pulses, above the signal intensity threshold level, such as at 206 in FIG. 2. Assuming the signal intensity threshold level is correct, the high intensity peaks exceeding the threshold level correspond to (nano)particle ionization/detection events, i.e., the measurement of individual (metal or metal-containing) nanoparticles undissolved (or suspended) in the sample. The signal intensity threshold level may thus be considered as the nanoparticle baseline.

From FIG. 2, it is evident that accurately distinguishing the nanoparticles from the dissolved metals of a sample under analysis requires accurately determining the correct signal intensity threshold level as the nanoparticle baseline. For comparison, FIG. 2 shows two calculated baselines labeled "Old" and "New," respectively. As shown, the inappropriate (or less accurate, Old) baseline fails to adequately separate the particle peaks (e.g., 206) from the background signals (e.g., 204). Consequently, the inappropriate baseline results in falsely identifying several small peaks in the background signals as being particle peaks. Noise signals are over-counted, and particle peaks are covered by noise signals, as shown in the lower inset of FIG. 2. By contrast, the New baseline as determined by performing the method described herein is more accurate and hence allows a more accurate discrimination of true particle peaks (those which correspond to actual nanoparticles) from background noise. Noise signals are eliminated, and particle peaks can be separated, as shown in the upper inset of FIG. 2. Accurate calculation of the signal distribution as disclosed herein results in accurate calculation of the particle detection threshold.

Figures 3A, 3B:
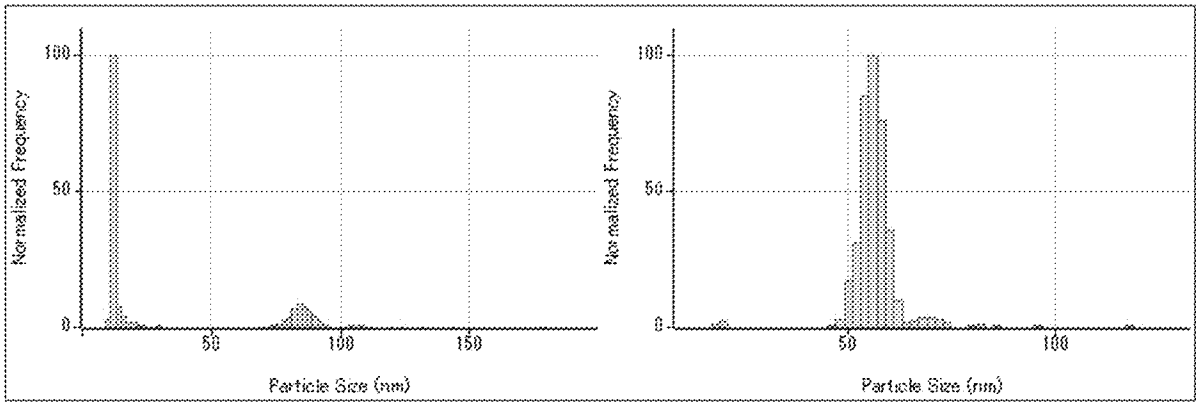
FIG. 3A is an example of a plot of size distribution calculated from raw sample data acquired from a reference solution containing only 60-nm gold (Au) nanoparticles (NIST8013) 50 ppt, where the calculation is based on an incorrect threshold for distinguishing between particle data and ionic data.
FIG. 3B is a plot of size distribution calculated from the same raw sample data as regards FIG. 3A, where the calculation is based on a correct threshold determined in accordance with a method of the present disclosure.

The failure to accurately and correctly discriminate in the raw sample data between the particle fraction and the dissolved "ionic" fraction of the sample can lead to inaccurate calculations of nanoparticle data (properties or attributes). As an example, FIG. 3A is an example of a plot of size distribution calculated using an incorrect particle detection threshold for distinguishing between particle data and ionic data. The size distribution was calculated from raw sample data acquired from a reference solution containing only 60-nm gold (Au) nanoparticles (NIST8013) 50 parts-per-trillion (ppt), where NIST refers to the National Institute of Standards and Technology. FIG. 3A incorrectly indicates a very high frequency of particles calculated as having a size of 10 nm, and a very low frequency of particles calculated as having a size of 60 nm. By comparison, FIG. 3B is a plot of size distribution calculated using a correct particle threshold, determined in accordance with the method described herein. FIG. 3B correctly indicates that the highest frequency of particles detected are particles having a size of 60 nm, which correspond to the gold nanoparticles contained in the reference sample analyzed.

To address the problem of accurately and correctly discriminating between particle signals and background ionic signals, a method for analyzing nanoparticles in a sample by single-particle inductively coupled plasma-mass spectrometry (spICP-MS), according to an embodiment of the present disclosure, will now be described with reference to FIGS. 4-8.

Figure 4:
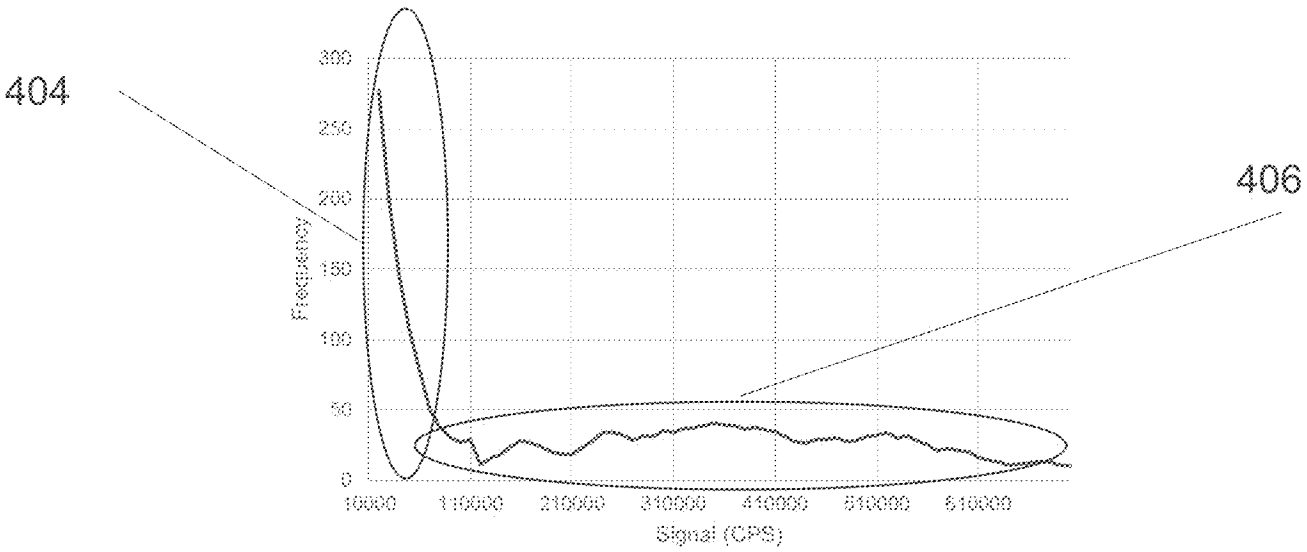
FIG. 4 is a plot of an example of a signal distribution resulting from analyzing a sample containing nanoparticles.

FIG. 4 is a plot of an example of a signal distribution (signal distribution data) resulting from analyzing a sample containing nanoparticles. The sample analysis may be performed by operating a system such as the ICP-MS system 100 described above and illustrated in FIG. 1, which is configured as needed for the single-particle mode of operation. The signal distribution may be calculated from the raw time scale (signal intensity-versus-time) data acquired for the sample, such as shown in FIG. 2.

The signal distribution includes two principal portions: an ionic signal portion 404 and a particle signal portion 406. The ionic signal portion 404 contains the signal distributions for the dissolved "ionic" fraction of the sample. The ionic signal portion 404 is characterized by high frequencies of small signal intensities measured by the ion detector, the terms "high" and "small" being relative to the particle signal portion 406. However, the frequencies of the ionic signal portion 404 rapidly reduce over a relatively narrow range of signal intensities. The particle signal portion 406 contains the signal distribution for "particle" components (e.g., nanoparticles) of the sample. The particle signal portion 406 is characterized by low frequencies of high signal intensities, distributed over a wide range of signal intensities, relative to the ionic signal portion 404.

According to the present disclosure, the intersection point of characteristics from these two fractions, i.e. the intersection of the ionic signal portion 404 and the particle signal portion 406 of the signal distribution, is taken to be the candidate for a "particle detection threshold." In this context, the value determined for the particle detection threshold may be taken to represent the detection limit utilized to distinguish between particle signals and dissolved background signals ("ionic" signals). As it is typically difficult to reliably determine the characteristic for particle signals in various samples, the present method according to an embodiment evaluates the characteristic of the dissolved background signals on the signal distribution, namely the ionic signal portion 404, to determine the value for the particle detection threshold.

Figure 5B:
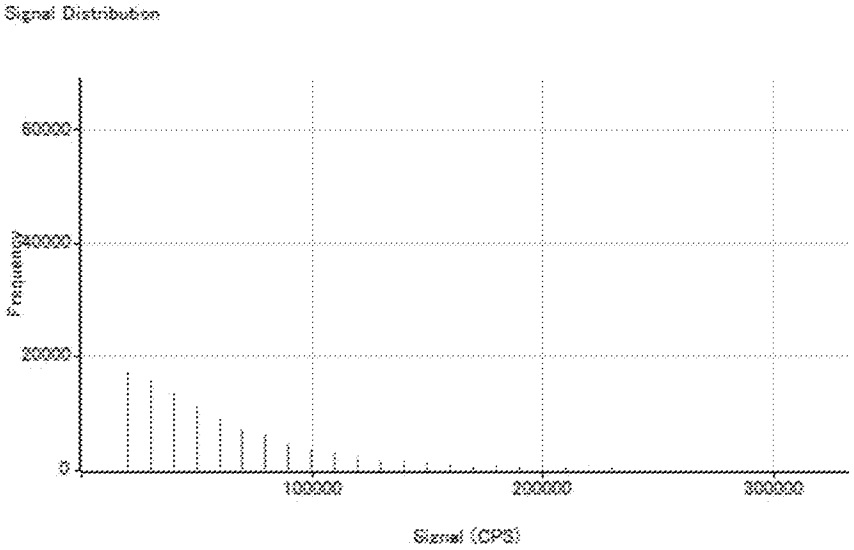
FIG. 5B is a plot of an example of a signal distribution relating to the same analysis as shown in FIG. 5A, after integrating the raw signals.
Figure 5A:
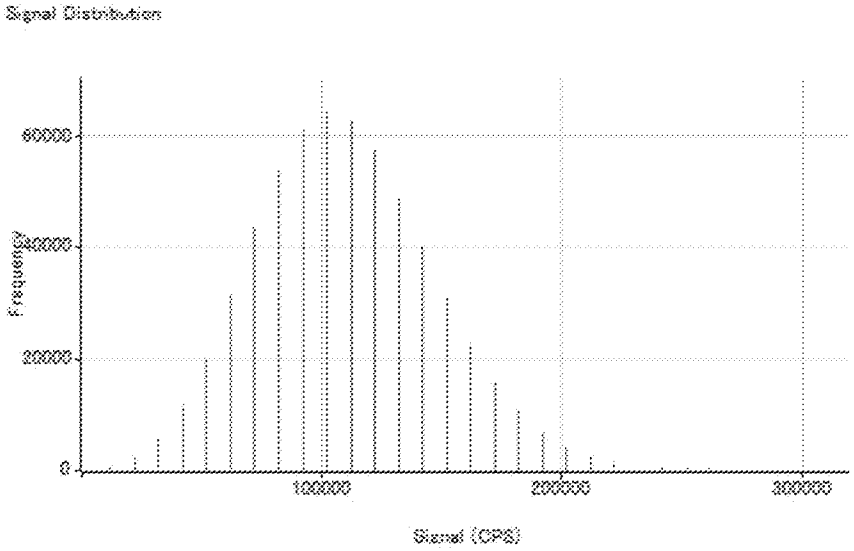
FIG. 5A is a plot of an example of a signal distribution resulting from analyzing an ionic solution without nanoparticles, before integrating the raw signals.

Considering first an assumed ionic solution without nanoparticles, the raw signals from the ionic standard generally follow a Poisson distribution, as shown by the signal distribution in FIG. 5A. To calculate the ionic signal distribution, the raw signals are integrated and the signals within each period are counted. The signal distribution after integration follows an exponential distribution, as illustrated in FIG. 5B.

The distribution for ion signals occurring k times over a duration, t (>0), at a rate of 1/T per unit time, may be expressed as the Poisson probability density function:

$$f(k, t) = A \cdot \frac{(t/T)^k}{k!} \cdot e^{-(t/T)}$$

where the dimensionless quantity A depends on the pattern of the signal distribution (data points of frequency versus intensity).

Setting B=1/T and k=0, the distribution for integrated ionic signals is calculated as a Poisson process, as follows:

$$f(0,t)=A\cdot e^{-Bt}$$

The above equation focuses on the frequency of the occurrence of signals (detection events) via the Poisson process to approximate the ionic signal distribution. This is in contrast to the approach before Poisson process that focuses on the number of occurrences.

Figure 6B:
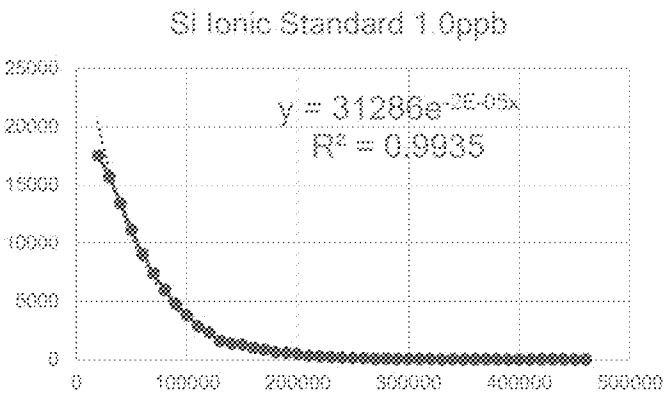
FIG. 6B is a plot of an example of a signal distribution obtained for a Si ionic standard solution 1.0 ppb.
Figure 6A:
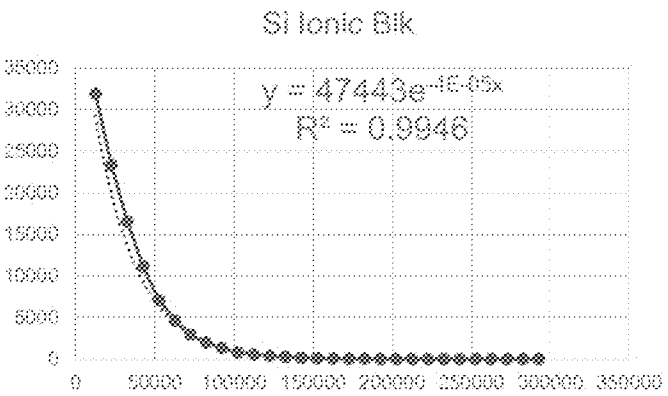
FIG. 6A is a plot of an example of a signal distribution obtained for a silicon (Si) ionic blank solution.

FIG. 6A is a plot of an example of signal distribution obtained for a silicon (Si) ionic blank solution, and FIG. 6B is a plot of an example of signal distribution obtained for a Si ionic standard solution 1.0 parts-per-billion (ppb). Signals were integrated and curves were calculated using the least squares method for an exponential curve, which is expressed as:

$$y=a\cdot e^{bx}$$

where x corresponds to the value of signal intensity on the abscissa, y corresponds to the value of frequency on the ordinate, and a and b are calculated as:

$$a = \exp\left(\frac{\sum_{i=1}^{n} x_i^2 \sum_{i=1}^{n} \log_e y_i - \sum_{i=1}^{n} x_i \log_e y_i \sum_{i=1}^{n} x_i}{n\sum_{i=1}^{n} x_i^2 - \left(\sum_{i=1}^{n} x_i\right)^2}\right)$$

$$b = \frac{n\sum_{i=1}^{n} x_i \log_e y_i - \sum_{i=1}^{n} x_i \sum_{i=1}^{n} \log_e y_i}{n\sum_{i=1}^{n} x_i^2 - \left(\sum_{i=1}^{n} x_i\right)^2}$$

The correlations are in good agreement with the calculated exponential curves, thereby demonstrating that the ionic component on the signal distribution can be evaluated by the approximation of an exponential curve.

Figure 7:
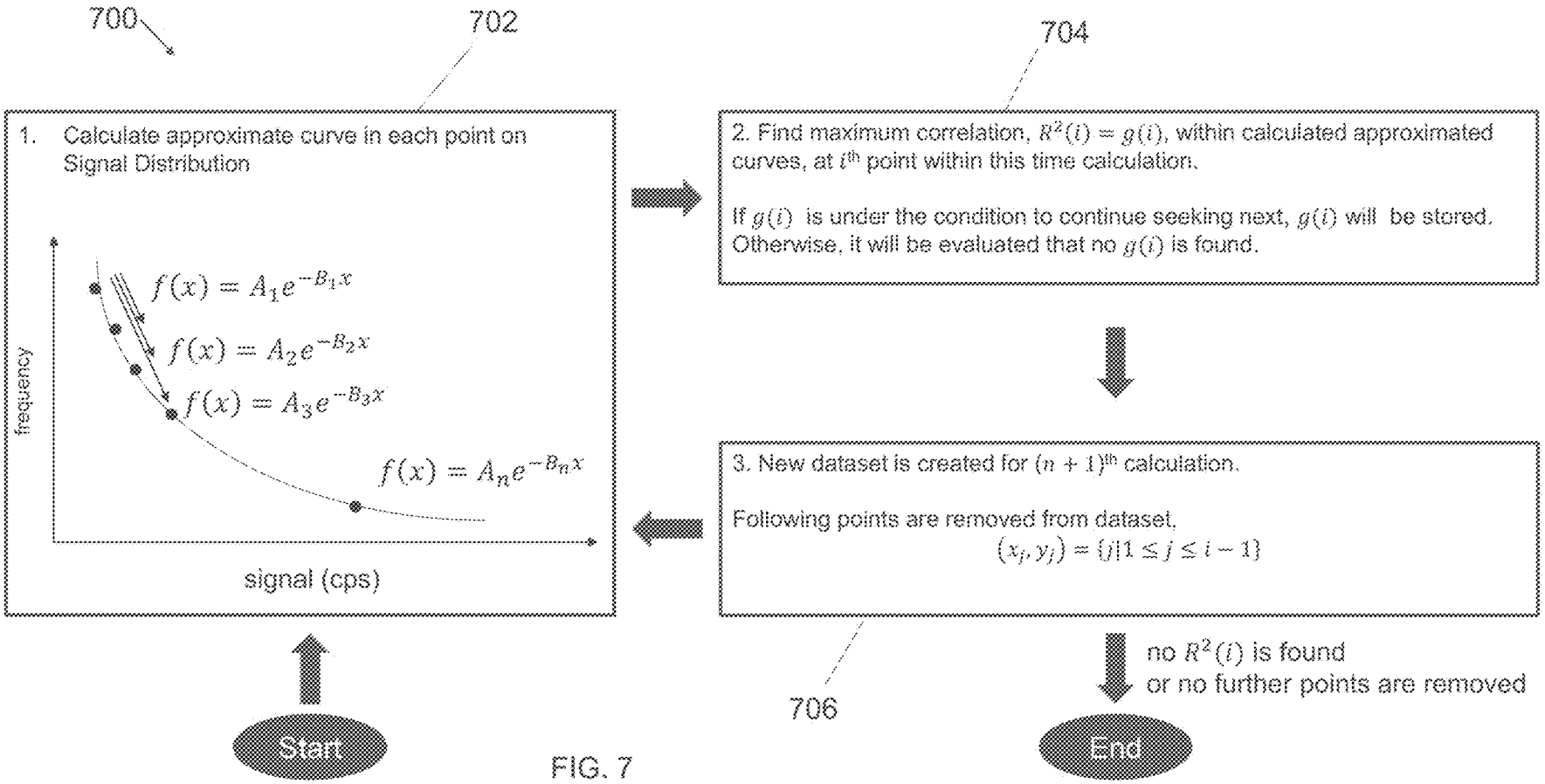
FIG. 7 is a flow diagram illustrating an example of a method for determining a particle detection threshold according to an embodiment of the present disclosure.

With the foregoing in mind, FIG. 7 is a flow diagram 700 illustrating an example of a method for determining a particle detection threshold according to an embodiment disclosed herein. In this embodiment, the method determines where the particle detection threshold is located on a signal distribution obtained from an analysis of a given sample, by evaluating the characteristic of the ionic signal portion of the signal distribution. Specifically, the signal distribution is calculated from the raw time scan data (e.g., as shown in FIG. 2) acquired from an spICP-MS analysis performed on the sample.

First, as illustrated in FIG. 7, an approximated curve is calculated for different sets of the data points (x, f(x)) on the signal distribution (step 702), using an exponential equation of the following form:

$$f(x)=A_n\cdot e^{-B_n x}$$

where xis the value on the abscissa of the signal distribution (signal intensity), f(x) is the value on the ordinate of the signal distribution (frequency), and n is the total number of calculations performed during one iteration of step 702. For example, assuming the data points from the signal distribution are (x1, f(x1)), (x2, f(x2)), (x3, f(x3)), and (x4, f(x4)), the following sets of the data points are utilized to calculate the approximated curves:

Curve1: $(x1,f(x1)),(x2,f(x2))$

Curve2: $(x1,f(x1)),(x2,f(x2)),(x3,f(x3))$

Curve3: $(x1,f(x1)),(x2,f(x2)),(x3,f(x3)),(x4,f(x4))$

. . .

CurveN: $(x1,f(x1)),(x2,f(x2)) \ldots (x(N+1),f(x(N+1)))$.

Thus, for example, as illustrated in FIG. 7, the first three and last approximated curves calculated are, respectively:

$$f(x)=A_1\cdot e^{-B_1 x}$$

$$f(x)=A_2\cdot e^{-B_2 x}$$

$$f(x)=A_3\cdot e^{-B_3 x}$$

$$f(x)=A_n\cdot e^{-E_n x}$$

Second, the coefficients of determination, $R^2(i)$, are calculated (step 704) for all data points within the calculated approximated curves. The coefficients of determination are evaluated to find the maximum correlation, g(i), i.e. to find $R^2(i)=g(i)$, for each approximated curve. The value g(i) is the most proper coefficient of determination found in the coefficients of determination $R^2(i)$ calculated using all points in the nth repetitive calculation. For example, assume again that the dataset has five points A, B, C, D, and E in the nth repetitive calculation. In this case, the coefficients of determination having the maximum correlation are calculated as follows:

g(1) is calculated by using A and B.

g(2) is calculated by using A, B, and C.

g(3) is calculated by using A, B, C and D.

g(4) is calculated by using A, B, C, D, and E.

The algorithm will evaluate which g(i) is most effective, i.e. which g(i) is the maximum correlation.

If g(i) is evaluated to be the maximum correlation, the signal corresponding to the ith point is stored as the candidate for the particle detection threshold at this iteration.

Otherwise, it is determined that no candidate was found at this iteration.

Third, a new dataset is created for the (n+1)th calculation (step 706) by removing following points from the previous dataset:

$$(x_j,y_j)=\{j|1\leq j\leq i-1\}$$

For example, in the above example of calculations using the previous dataset of A, B, C, D, and E, if g(2) is evaluated to be the most effective coefficient of determination, data point A will be removed, and the next dataset will then contain B, C, D and E. The above procedure (steps 702 and 704) will then be repeated for the new dataset consisting of B, C, D and E.

If, in the current iteration of calculations on the current dataset, no candidate is found, or no further data points are removed, the last candidate determined in step 704 will be determined to be the particle detection threshold. Otherwise, the repetitive calculation will continue following the above procedure (steps 702, 704, and 706).

If there is no candidate within the entire iterative calculation, it is determined that the particle detection threshold has not been found. In this situation, it is determined that no particles have been detected in the sample.

Figure 8:
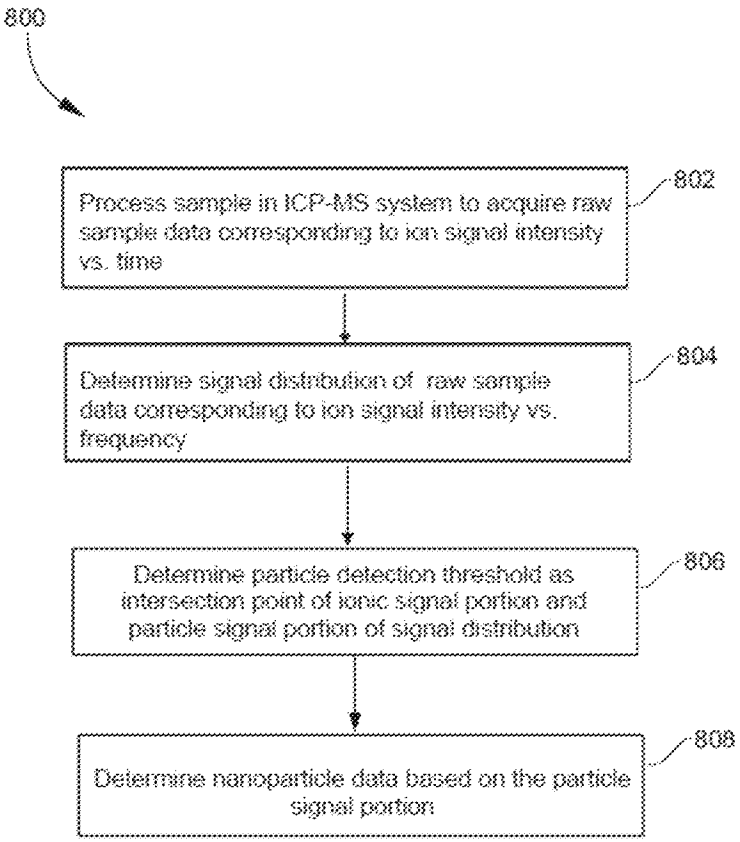
FIG. 8 is a flow diagram illustrating an example of a method for analyzing nanoparticles in a sample by single-particle inductively coupled plasma-mass spectrometry (spICP-MS) according to an embodiment of the present disclosure.

FIG. 8 is a flow diagram 800 illustrating an example of a method for analyzing nanoparticles in a sample by single-particle inductively coupled plasma-mass spectrometry (spICP-MS).

According to the method, the sample is processed in an ICP-MS system to acquire raw sample data corresponding to ion signal intensity as a function of time (see, e.g., FIG. 2) measured by an ion detector of the ICP-MS system (step 802). The processing of the sample may include a combination of various steps described above in conjunction with the ICP-MS system 100 illustrated in FIG. 1, such as sample introduction, nebulization, atomization/ionization, mass filtering, interference suppression (e.g., by collision/reaction), mass analysis, ion detecting/counting, signal processing/data acquisition, etc.

A signal distribution of the raw sample data is then determined or calculated (step 804). As described above, the signal distribution consists of or corresponds to a plurality of data points. Each data point is defined by or corresponds to ion signal intensity and the frequency at which the ion detector measured the ion signal intensity (see, e.g., FIG. 4).

A particle detection threshold is then determined using the signal distribution data (step 806). Specifically, the particle detection threshold is determined as an intersection point of an ionic signal portion of the signal distribution and a particle signal portion of the signal distribution. As described above in conjunction with FIG. 4, the particle signal portion corresponds to measurements of nanoparticles in the sample, and the ionic signal portion corresponds to measurements of components in the sample other than nanoparticles, such as metals dissolved in the sample solution. In this manner, the data corresponding to the particle signal portion, and thus corresponding to the nanoparticles detected in the sample, may be accurately identified and separated from all other data acquired from the sample during the current sample run.

In one embodiment, the particle detection threshold may be determined by evaluating a characteristic of the ionic signal portion. For example, the particle detection threshold may be determined by approximating the ionic signal portion as an exponential function according to the method described above and illustrated in FIG. 7. For example, determining the particle detection threshold may include: (1) calculating a plurality of approximate curves approximating the ionic signal portion, based on an exponential function in which data points of the signal distribution are inputs; (2) calculating coefficients of determination of the data points within the approximate curves; (3) determining which of the coefficients of determination is a maximum correlation; and (4) determining the data point corresponding to the maximum correlation to be the particle detection threshold.

The particle signal portion is then utilized to determine or calculate nanoparticle data (step 808). The nanoparticle data may include, but is not limited to, mass spectra, particle number concentration, elemental composition, particle size, particle size distribution, etc.

In an embodiment, the flow diagram 800 may represent an ICP-MS system, or part of an ICP-MS system, configured to carry out steps 802-808. For this purpose, a controller (e.g., the controller 120 shown in FIG. 1) including a processor, memory, and other components as appreciated by persons skilled in the art, may be provided to control the performance of steps 802-808, such as by controlling the components of the ICP-MS system involved in carrying out steps 802-808.

The method disclosed herein may provide advantages over known methods such as the iterative n*σ algorithm. The method disclosed herein enables the determination of a more accurate particle detection threshold, which in turn enables particle data to be determined or calculated more accurately. Moreover, the method disclosed herein enables precise results to be calculated automatically, i.e., without user intervention. For example, the method determines the particle detection threshold without requiring the user to visually evaluate the signal distribution data in order to make such a determination. This is also advantageous for performing multi-element analysis, which if done by a manual method would be very time-consuming.

FIGS. 9 and 10 are tables (Table 1 and Table 2) comparing the results obtained from analyzing reference solutions by spICP-MS in five sample runs, utilizing the presently disclosed method ("New Algorithm") versus the conventional algorithm ("Conventional Algorithm"). FIG. 9 contains data (number of particles, median size, mean size, and most frequent size of particles) obtained from analysis of NIST 8012 (Au 30 nm) 5 ppt particles, and FIG. 10 contains the same type of data obtained from analysis of NIST 8013 (Au 60 nm) 50 ppt particles. In each table, the percent relative standard deviation (% RSD) of the data obtained by the presently disclosed method is significantly lower than the % RSD of the data obtained by the conventional algorithm. This demonstrates that the presently disclosed method provides significantly better precision and repeatability when it is utilized in the sample analysis.

FIG. 11 is a table (Table 3) comparing the results obtained from analyzing several reference solutions, each containing 100 nm Ag NPs but with different ionic concentrations, by spICP-MS, utilizing the presently disclosed method ("New Algorithm") versus the conventional algorithm ("Conventional Algorithm"). Again, the percent relative standard deviation (% RSD) of the data obtained by the presently disclosed method is significantly lower than the % RSD of the data obtained by the conventional algorithm. In addition, the data in FIG. 11 demonstrate that even when an ionic solution is added to an NP sample, the presently disclosed method may be utilized to calculate results precisely.

Figure 12B:
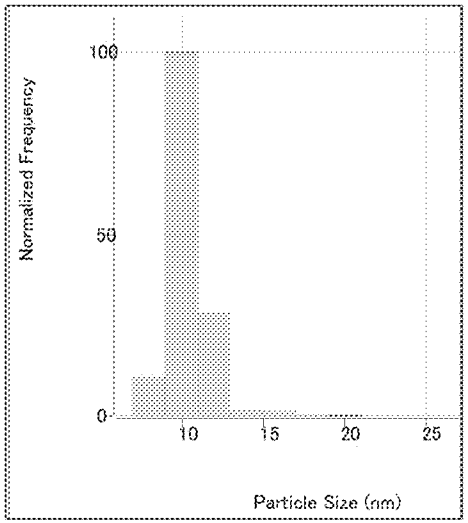
FIG. 12B is a plot of size distribution calculated from the same raw sample data as relates to FIG. 12A, but in which the method disclosed herein was utilized to calculate a particle detection threshold to separate the particle signals from the ionic signals.
Figure 12A:
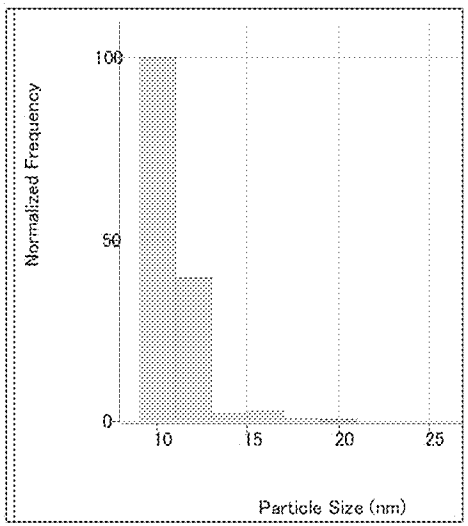
FIG. 12A is a plot of size distribution calculated from raw sample data acquired from an spICP-MS analysis of a sample solution containing NIST8011 (Au 10 nm) 0.25 ppt particles, in which a conventional algorithm was utilized to separate the particle signals from the ionic signals.

Moreover, the method disclosed herein enables accurate results to be calculated automatically even when analyzing particles of appreciably small size. As an example, FIG. 12A is a plot of size distribution calculated from raw sample data acquired from an spICP-MS analysis of a sample solution containing NIST 8011 (Au 10 nm) 0.25 ppt particles, in which the conventional algorithm was utilized to separate the particle signals from the ionic signals. By comparison, FIG. 12B is a plot of size distribution calculated from the same raw sample data as relates to FIG. 12A, but in which the method disclosed herein was utilized to calculate a particle detection threshold to separate the particle signals from the ionic signals. FIGS. 12A and 12B demonstrate the improved accuracy of the method disclosed herein.

Figure 13B:
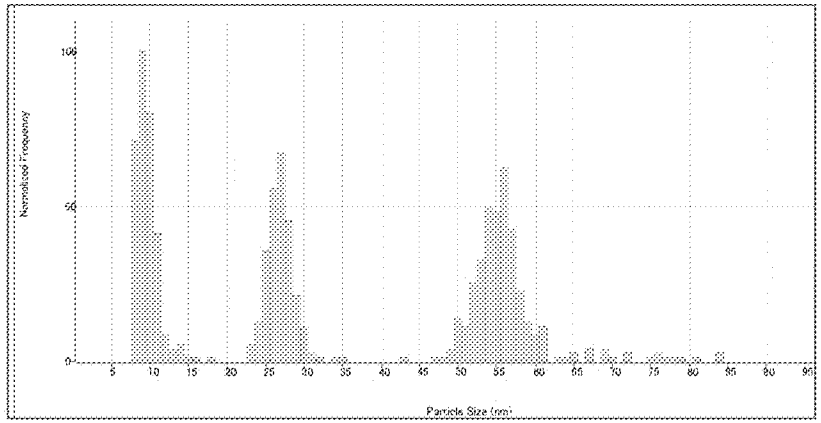
FIG. 13B is a plot of size distribution calculated from raw sample data acquired from an spICP-MS analysis of a sample solution containing another mixture of NIST 8011, 8012, and 8013 Au NPs (10 nm: 0.1 ppt, 30 nm: 2 ppt, 60 nm: 30 ppt), in which the method disclosed herein was utilized to calculate a particle detection threshold to separate the particle signals from the ionic signals.
Figure 13A:
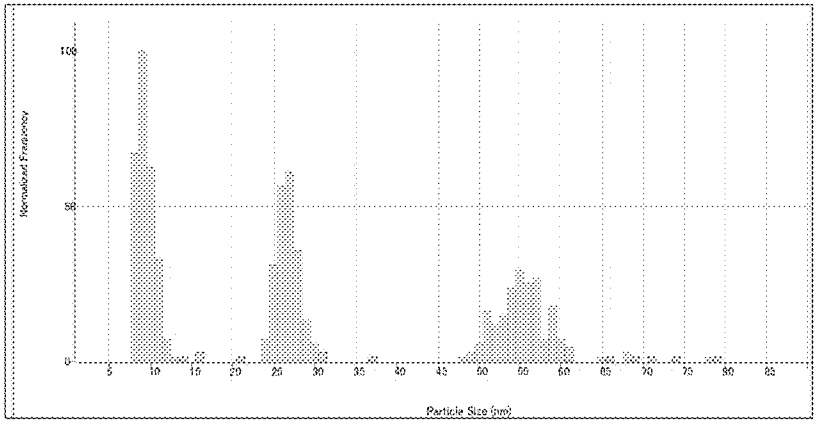
FIG. 13A is a plot of size distribution calculated from raw sample data acquired from an spICP-MS analysis of a sample solution containing a mixture of NIST 8011, 8012, and 8013 Au NPs (10 nm: 0.08 ppt, 30 nm: 1.7 ppt, and 60 nm: 17 ppt), in which the method disclosed herein was utilized to calculate a particle detection threshold to separate the particle signals from the ionic signals.

The method disclosed herein also allows accurate results to be calculated from analyses of sample containing a mixture of differently sized particles. As an example, FIGS. 13A and 13B are plots of size distribution calculated from raw sample data acquired from an spICP-MS analysis of sample solutions containing two different mixtures of NIST 8011, 8012, and 8013 Au NPs, in which the method disclosed herein was utilized to calculate a particle detection threshold to separate the particle signals from the ionic signals. Specifically, FIG. 13A relates to an analysis of a mixture of 10 nm: 0.08 ppt, 30 nm: 1.7 ppt, and 60 nm: 17 ppt Au NPs, and FIG. 13B relates to an analysis of a mixture of 10 nm: 0.1 ppt, 30 nm: 2 ppt, 60 nm: 30 ppt Au NPs.

FIG. 14 (Table 4) is a table comparing the results obtained from analyzing reference solutions containing 20 nm Ag NPs in different concentrations (1 ppt, 2 ppt, 5 ppt, 10 ppt, 20 ppt, 50 ppt, and 100 ppt), utilizing the presently disclosed method ("New Algorithm") versus the conventional algorithm ("Conventional Algorithm"). Again, the relative standard deviation (RSD) of the data obtained by the presently disclosed method is significantly lower than the RSD of the data obtained by the conventional algorithm. In addition, the data in FIG. 14 demonstrate that even when the NP concentration is different, the presently disclosed method is able to calculate results accurately.

Figure 15A:
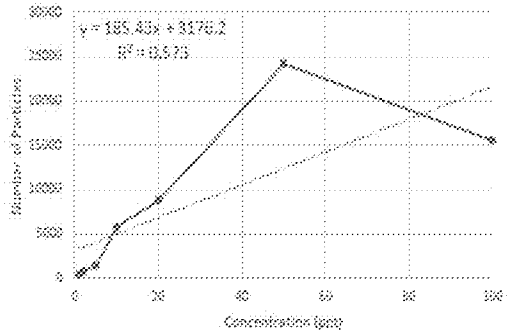
FIG. 15A is a plot of concentration (number of particles calculated as a function of particle concentration in ppt) based on the data shown in FIG. 14 (Table 4), in which the conventional algorithm was utilized to separate the particle signals from the ionic signals.
Figure 15B:
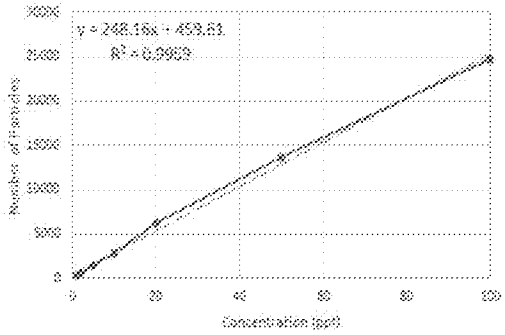
FIG. 15B is a plot of concentration based on the same data as relates to FIG. 15A, but in which the method disclosed herein was utilized to calculate a particle detection threshold to separate the particle signals from the ionic signals.

FIG. 15A is a plot of concentration (number of particles calculated as a function of particle concentration in ppt) based on the data shown in FIG. 14 (Table 4), in which the conventional algorithm was utilized to separate the particle signals from the ionic signals. By comparison, FIG. 15B is a plot of concentration based on the same data, but in which the method disclosed herein was utilized to calculate a particle detection threshold to separate the particle signals from the ionic signals. FIGS. 15A and 15B demonstrate that the data produced from implementing the method disclosed herein has good linearity, and much better linearity compared to use of the conventional algorithm.

FIG. 16 (Table 5) is a table comparing the calculated number of particles from analyses of ultra-pure water (UPW), blank, and several Au ionic samples with different concentrations, utilizing the presently disclosed method ("New Algorithm") versus the conventional algorithm ("Conventional Algorithm"). FIG. 16 demonstrates that implementing the presently disclosed method can prevent over-counting of the number of particles for ionic/blank solutions that do not contain NPs.

Figure 17:
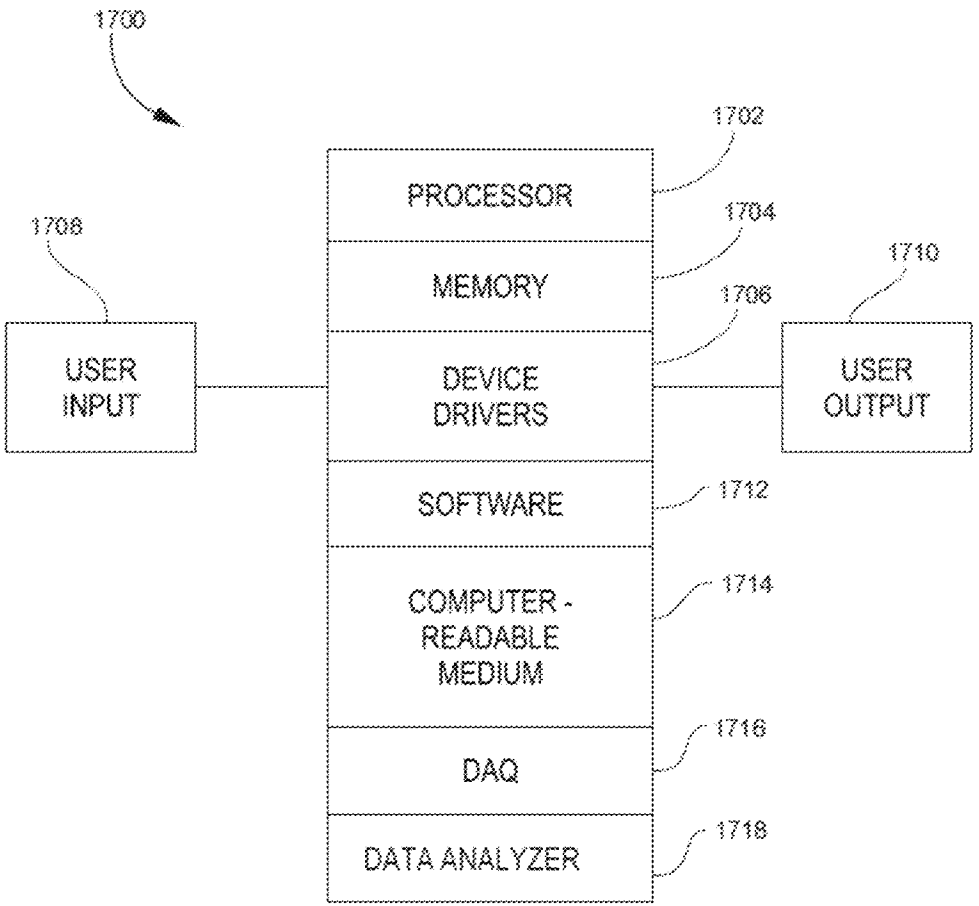
FIG. 17 is a schematic view of an example of a system controller (or controller, or computing device) that may be part of or communicate with a spectrometry system such as the ICP-MS system illustrated in FIG. 1.

FIG. 17 is a schematic view of a non-limiting example of a system controller (or controller, or computing device) 1700 that may be part of or communicate with a spectrometry system according to an embodiment of the present disclosure. For example, the system controller 1700 may correspond to the system controller 120 of the ICP-MS system 100 described above and illustrated in FIG. 1.

In the illustrated embodiment, the system controller 1700 includes a processor 1702 (typically electronics-based), which may be representative of a main electronic processor providing overall control, and one or more electronic processors configured for dedicated control operations or specific signal processing tasks (e.g., a graphics processing unit or GPU, a digital signal processor or DSP, an application-specific integrated circuit or ASIC, a field-programmable gate array or FPGA, etc.). The system controller 1700 also includes one or more memories 1704 (volatile and/or non-volatile) for storing data and/or software. The system controller 1700 may also include one or more device drivers 1706 for controlling one or more types of user interface devices and providing an interface between the user interface devices and components of the system controller 1700 communicating with the user interface devices. Such user interface devices may include user input devices 1708 (e.g., keyboard, keypad, touch screen, mouse, joystick, trackball, and the like) and user output devices 1710 (e.g., display screen, printer, visual indicators or alerts, audible indicators or alerts, and the like). In various embodiments, the system controller 1700 may be considered as including one or more of the user input devices 1708 and/or user output devices 1710, or at least as communicating with them. The system controller 1700 may also include one or more types of computer programs or software 1712 contained in memory and/or on one or more types of computer-readable media 1714. The computer programs or software may contain non-transitory instructions (e.g., logic instructions) for controlling or performing various operations of the ICP-MS system 100. The computer programs or software may include application software and system software. System software may include an operating system (e.g., a Microsoft Windows® operating system) for controlling and managing various functions of the system controller 1700, including interaction between hardware and application software. In particular, the operating system may provide a graphical user interface (GUI) displayable via a user output device 1710, and with which a user may interact with the use of a user input device 1708. The system controller 1700 may also include one or more data acquisition/signal conditioning components (DAQs) 1716 (as may be embodied in hardware, firmware and/or software) for receiving and processing ion measurement signals outputted by the ion detector 161 (FIG. 1), including formatting data for presentation in graphical form by the GUI.

The system controller 1700 may further include a data analyzer (or module) 1718 configured to process signals outputted from the ion detector 161 and produce data therefrom, including (nano)particle data, as described throughout the present disclosure. Thus, the data analyzer 1718 may be configured to control or perform all or part of any of the methods disclosed herein. The data analyzer 1718 may be configured to execute all or part of any of the algorithms disclosed herein. For these purposes, the data analyzer 1718 may be embodied in software and/or electronics (hardware and/or firmware) as appreciated by persons skilled in the art.

It will be understood that FIG. 17 is high-level schematic depiction of an example of a system controller 1700 consistent with the present disclosure. Other components, such as additional structures, devices, electronics, and computer-related or electronic processor-related components may be included as needed for practical implementations. It will also be understood that the system controller 1700 is schematically represented in FIG. 17 as functional blocks intended to represent structures (e.g., circuitries, mechanisms, hardware, firmware, software, etc.) that may be provided. The various functional blocks and any signal links between them have been arbitrarily located for purposes of illustration only and are not limiting in any manner Persons skilled in the art will appreciate that, in practice, the functions of the system controller 1700 may be implemented in a variety of ways and not necessarily in the exact manner illustrated in FIG. 17 and described by example herein.

EXEMPLARY EMBODIMENTS

Exemplary embodiments provided in accordance with the presently disclosed subject matter include, but are not limited to, the following:

1. A method for analyzing nanoparticles in a sample by single-particle inductively coupled plasma-mass spectrometry (spICP-MS), the method comprising: processing the sample in an ICP-MS system to acquire raw sample data corresponding to ion signal intensity as a function of time measured by an ion detector of the ICP-MS system; determining a signal distribution of the raw sample data corresponding to a plurality of data points, each data point corresponding to ion signal intensity and the frequency at which the ion detector measured the ion signal intensity; and determining a particle detection threshold as an intersection point of an ionic signal portion of the signal distribution and a particle signal portion of the signal distribution, wherein the particle signal portion corresponds to measurements of nanoparticles in the sample, the ionic signal portion corresponds to measurements of components in the sample other than nanoparticles, and the particle detection threshold separates the particle signal portion from the ionic signal portion.

2. The method of embodiment 1, wherein determining the particle detection threshold comprises evaluating a characteristic of the ionic signal portion.

3. The method of embodiment 2, wherein evaluating a characteristic of the ionic signal portion comprises approximating the ionic signal portion as an exponential function.

4. The method of any of the preceding embodiments, wherein determining the particle detection threshold comprises: calculating a plurality of approximate curves approximating the ionic signal portion, based on an exponential function in which data points of the signal distribution are inputs; calculating coefficients of determination of the data points within the approximate curves; determining which of the coefficients of determination is a maximum correlation; and determining the data point corresponding to the maximum correlation to be the particle detection threshold.

5. The method of any of the preceding embodiments, comprising, after determining the particle detection threshold, determining nanoparticle data based on the particle signal portion.

6. The method of embodiment 5, wherein determining nanoparticle data is selected from the group consisting of: determining a mass spectrum; determining particle number concentration; determining elemental composition; determining particle size; determining particle size distribution; and a combination of two or more of the foregoing.

7. The method of any of the preceding embodiments, wherein processing the sample comprises producing ions by exposing the sample to an inductively coupled plasma, and transmitting at least some of the ions into a mass analyzer, and transmitting at least some of the ions from the mass analyzer to the ion detector.

8. The method of embodiment 7, wherein processing the sample comprises generating the inductively coupled plasma in a torch box, transmitting the ions from the torch box into a collision/reaction cell to suppress interferences, and transmitting at least some of the ions from the collision/reaction cell into the mass analyzer.

9. The method of any of the preceding embodiments, wherein processing the sample comprises flowing the sample into an ion source from a nebulizer or a spray chamber.

10. An inductively coupled plasma-mass spectrometry (ICP-MS) system for analyzing nanoparticles in a sample by single-particle inductively coupled plasma-mass spectrometry (spICP-MS), the ICP-MS system comprising: a torch box configured to generate plasma and produce ions from the sample in the plasma; a mass analyzer configured to separate the ions according to mass-to-charge ratio; an ion detector configured to count ions received from the mass analyzer; and a controller comprising an electronic processor and a memory, and configured to control the steps of the method of any of the preceding embodiments.

11. The ICP-MS system of embodiment 10, comprising a collision/reaction cell positioned between the ion source and the mass analyzer and configured to suppress interferences.

12. A non-transitory computer-readable medium, comprising instructions stored thereon, that when executed on a processor, control or perform the steps of the method of any of the preceding embodiments.

13. A system comprising the computer-readable storage medium of embodiment 12.

It will be understood that one or more of the processes, sub-processes, and process steps described herein may be performed by hardware, firmware, software, or a combination of two or more of the foregoing, on one or more electronic or digitally-controlled devices. The software may reside in a software memory (not shown) in a suitable electronic processing component or system such as, for example, the computing device 120 or 1700 schematically depicted in FIG. 1 or 17. The software memory may include an ordered listing of executable instructions for implementing logical functions (that is, "logic" that may be implemented in digital form such as digital circuitry or source code, or in analog form such as an analog source such as an analog electrical, sound, or video signal). The instructions may be executed within a processing module, which includes, for example, one or more microprocessors, general purpose processors, combinations of processors, digital signal processors (DSPs), field-programmable gate arrays (FPGAs), or application specific integrated circuits (ASICs). Further, the schematic diagrams describe a logical division of functions having physical (hardware and/or software) implementations that are not limited by architecture or the physical layout of the functions. The examples of systems described herein may be implemented in a variety of configurations and operate as hardware/software components in a single hardware/software unit, or in separate hardware/software units.

The executable instructions may be implemented as a computer program product having instructions stored therein which, when executed by a processing module of an electronic system (e.g., the computing device 120 or 1700 in FIG. 1 or 17), direct the electronic system to carry out the instructions. The computer program product may be selectively embodied in any non-transitory computer-readable storage medium for use by or in connection with an instruction execution system, apparatus, or device, such as an electronic computer-based system, processor-containing system, or other system that may selectively fetch the instructions from the instruction execution system, apparatus, or device and execute the instructions. In the context of this disclosure, a computer-readable storage medium is any non-transitory means that may store the program for use by or in connection with the instruction execution system, apparatus, or device. The non-transitory computer-readable storage medium may selectively be, for example, an electronic, magnetic, optical, electromagnetic, infrared, or semiconductor system, apparatus, or device. A non-exhaustive list of more specific examples of non-transitory computer readable media include: an electrical connection having one or more wires (electronic); a portable computer diskette (magnetic); a random access memory (electronic); a read-only memory (electronic); an erasable programmable read only memory such as, for example, flash memory (electronic); a compact disc memory such as, for example, CD-ROM, CD-R, CD-RW (optical); and digital versatile disc memory, i.e., DVD (optical). Note that the non-transitory computer-readable storage medium may even be paper or another suitable medium upon which the program is printed, as the program may be electronically captured via, for instance, optical scanning of the paper or other medium, then compiled, interpreted, or otherwise processed in a suitable manner if necessary, and then stored in a computer memory or machine memory.

It will also be understood that the term "in signal communication" as used herein means that two or more systems, devices, components, modules, or sub-modules are capable of communicating with each other via signals that travel over some type of signal path. The signals may be communication, power, data, or energy signals, which may communicate information, power, or energy from a first system, device, component, module, or sub-module to a second system, device, component, module, or sub-module along a signal path between the first and second system, device, component, module, or sub-module. The signal paths may include physical, electrical, magnetic, electromagnetic, electrochemical, optical, wired, or wireless connections. The signal paths may also include additional systems, devices, components, modules, or sub-modules between the first and second system, device, component, module, or sub-module.

More generally, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A method for analyzing nanoparticles in a sample by single-particle inductively coupled plasma-mass spectrometry (spICP-MS), the method comprising:

processing the sample in an ICP-MS system to acquire raw sample data corresponding to ion signal intensity as a function of time measured by an ion detector of the ICP-MS system;

determining a signal distribution of the raw sample data corresponding to a plurality of data points, each data point corresponding to ion signal intensity and the frequency at which the ion detector measured the ion signal intensity; and determining a particle detection threshold as an intersection point of an ionic signal portion of the signal distribution and a particle signal portion of the signal distribution, wherein the particle signal portion corresponds to measurements of nanoparticles in the sample, the ionic signal portion corresponds to measurements of components in the sample other than nanoparticles, and the particle detection threshold separates the particle signal portion from the ionic signal portion.

2. The method of claim 1, wherein determining the particle detection threshold comprises evaluating a characteristic of the ionic signal portion.

3. The method of claim 2, wherein evaluating a characteristic of the ionic signal portion comprises approximating the ionic signal portion as an exponential function.

4. The method of claim 1, wherein determining the particle detection threshold comprises:

calculating a plurality of approximate curves approximating the ionic signal portion, based on an exponential function in which data points of the signal distribution are inputs;

calculating coefficients of determination of the data points within the approximate curves;

determining which of the coefficients of determination is a maximum correlation; and determining the data point corresponding to the maximum correlation to be the particle detection threshold.

5. The method of claim 1, comprising, after determining the particle detection threshold, determining nanoparticle data based on the particle signal portion.

6. The method of claim 5, wherein determining nanoparticle data is selected from the group consisting of: determining a mass spectrum; determining particle number concentration; determining elemental composition; determining particle size; determining particle size distribution; and a combination of two or more of the foregoing.

7. The method of claim 1, wherein processing the sample comprises producing ions by exposing the sample to an inductively coupled plasma, and transmitting at least some of the ions into a mass analyzer, and transmitting at least some of the ions from the mass analyzer to the ion detector.

8. The method of claim 7, wherein processing the sample comprises generating the inductively coupled plasma in a torch box, transmitting the ions from the torch box into a collision/reaction cell to suppress interferences, and transmitting at least some of the ions from the collision/reaction cell into the mass analyzer.

9. The method of claim 1, wherein processing the sample comprises flowing the sample into an ion source from a nebulizer or a spray chamber.

10. An inductively coupled plasma-mass spectrometry (ICP-MS) system for analyzing nanoparticles in a sample by single-particle inductively coupled plasma-mass spectrometry (spICP-MS), the ICP-MS system comprising:

a torch box configured to generate plasma and produce ions from the sample in the plasma;

a mass analyzer configured to separate the ions according to mass-to-charge ratio;

an ion detector configured to count ions received from the mass analyzer; and a controller comprising an electronic processor and a memory, and configured to control the steps of the method of claim 1.

11. The ICP-MS system of claim 10, comprising a collision/reaction cell positioned between the ion source and the mass analyzer and configured to suppress interferences.

12. A non-transitory computer-readable medium, comprising instructions stored thereon, that when executed on a processor, control or perform the steps of the method of claim 1.

13. A system comprising the computer-readable storage medium of claim 12.

* * * * *